US012187487B2

(12) United States Patent
Dent

(10) Patent No.: US 12,187,487 B2
(45) Date of Patent: Jan. 7, 2025

(54) LARGE LOAD CARRIER

(71) Applicant: Schoeller Allibert GmbH, Schwerin (DE)

(72) Inventor: Matthew Dent, Northwich (GB)

(73) Assignee: Schoeller Allibert GmbH, Schwerin (DE)

( * ) Notice: Subject to any disclaimer, the term of this patent is extended or adjusted under 35 U.S.C. 154(b) by 59 days.

(21) Appl. No.: 18/295,054

(22) Filed: Apr. 3, 2023

(65) Prior Publication Data

US 2024/0327066 A1 Oct. 3, 2024

(30) Foreign Application Priority Data

Feb. 8, 2022 (DE) ..... 10 2022 000 488.7

(51) Int. Cl.
*B65D 19/06* (2006.01)

(52) U.S. Cl.
CPC .... *B65D 19/06* (2013.01); *B65D 2519/00427* (2013.01); *B65D 2519/00567* (2013.01); *B65D 2519/00611* (2013.01)

(58) Field of Classification Search
CPC ..... B65D 19/12; B65D 19/16; B65D 19/36; B65D 19/02; B65D 19/06; B65D 2519/00427; B65D 2519/00567; B65D 2519/00611; B65D 19/385; B65D 2519/00; B65D 2585/6887; B65D 43/16
See application file for complete search history.

(56) References Cited

U.S. PATENT DOCUMENTS 5,123,533 A * 6/1992 Uitz ..... B65D 11/1873 206/509
5,275,302 A * 1/1994 Uitz ..... B65D 11/1873 220/4.28

(Continued)

FOREIGN PATENT DOCUMENTS

DE 102008047857 A1 4/2010
DE 102017113053 A1 12/2018
EP 3141492 A1 3/2017

OTHER PUBLICATIONS

Deutches Intellectual Property Organization, Search Report for German Application No. 10 2022 00488.7, mail date Jun. 20, 2024, 6 total pages.

(Continued)

*Primary Examiner* — Kareen K Thomas
(74) *Attorney, Agent, or Firm* — SoCal IP Law Group LLP; Mark Andrew Goldstein

(57) ABSTRACT

The invention relates to a heavy load carrier comprising peripherally arranged side walls which in an upright position define an interior of the heavy load carrier with a base, at least one of the side walls having a flap which seals a flap in the side wall in a closed position, the flap comprising first locking elements which can be brought into at least two states together with or separately from the flap, in the closed position, in a locked state the first locking elements cooperating with second locking elements of the side wall, such that the flap cannot be opened by pressure on the flap from the interior of the heavy load carrier perpendicular to a flap plane, and in an unlocked state the flap being able to be opened by pressure on the flap from the interior of the heavy load carrier perpendicular to the flap plane.

15 Claims, 5 Drawing Sheets

(56) References Cited

U.S. PATENT DOCUMENTS 5,722,328 A * 3/1998 Darby ..... B65D 19/06 206/600
6,182,849 B1 * 2/2001 Elstone, Sr. ..... B65D 19/12 220/4.28
6,427,947 B1 * 8/2002 Rohrlick ..... B64C 1/22 244/137.1
6,533,122 B1 * 3/2003 Plunkett ..... B65D 77/061 220/826
6,817,578 B1 * 11/2004 Garcia ..... B65D 19/42 244/137.1
2001/0035412 A1 * 11/2001 Kofod ..... B65D 19/12 220/7
2005/0178770 A1 8/2005 Hase et al.
2006/0260976 A1 11/2006 Apps
2007/0227937 A1 * 10/2007 Higgins ..... B65D 19/12 206/600
2007/0227938 A1 * 10/2007 Higgins ..... B65D 19/12 206/600
2009/0014445 A1 * 1/2009 Hay ..... B65D 19/18 220/6
2012/0012492 A1 * 1/2012 Darden ..... B65D 77/061 206/503
2012/0138554 A1 * 6/2012 Ness ..... B65D 19/06 211/71.01

OTHER PUBLICATIONS

Norm DIN EN13698-1 2004-01-00. Produktspezifikation Fur Paletten—Teil 1: Herstellung von 800 mm×1200 mm-Flachpaletten aus Holz; Deutsche Fassung EN 13698-1:2003, 28 total pages.

* cited by examiner

LARGE LOAD CARRIER

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from German Patent Application No. 10 2022 000 488.7, filed Feb. 8, 2022, entitled LARGE LOAD CARRIER, which is incorporated herein by reference in its entirety.

TECHNICAL FIELD

The invention relates to a heavy load carrier having the features of the preamble of claim 1.

PRIOR ART

Heavy load carriers, also known as large containers, are known for example from DE 10 2008 047 857 A1. The large container described therein may be formed in standard dimensions of 800 mm×600 mm, 1200×800 mm, 1200 mm×1000 mm or 1200 mm×1600 mm, specifically depending on the desired storage capacity. The height of the heavy load carrier is typically 1000 mm, but this can be defined relatively freely, and optimal exploitation of the loading area of a lorry often has a decisive influence.

Up to 99 heavy load carriers of this type of dimensions 1200 mm×800 mm×1000 mm can be arranged on a standard lorry in Europe, specifically eleven rows of heavy load containers arranged three on top of and three alongside one another. For goods transport, it is important that the heavy load carriers can be stacked stably.

The side walls of heavy load carriers of this type are typically collapsible, in such a way that a heavy load carrier merely has a height of approximately 300 mm in an empty transport position, while the outer dimensions of 1200 mm×800 mm remain constant. In the empty transport position, up to 363 heavy load containers of this type can be transported in a lorry in Europe.

The heavy load carrier of DE 10 2008 047 857 A1 comprises a base part and four side walls, of which at least one side wall has a displaceable side part formed in such a way that by linearly displacing the displaceable side part the side wall can be opened in part to allow access to the interior of the heavy load carrier. By means of a gripping element, the displaceable side part can be brought into an open position and a closed position in a longitudinal groove of the side wall by the user, in such a way that in a sealing position an outer face of the displaceable side part is flush with a side wall outer face and in an open position the two side parts overlap. The heavy load carrier could be improved as regards a pressure from the crate interior. When the heavy load carrier is filled with a lot of material, it is possible for the side wall flap to jam in its mounting and refuse to open.

A heavy load carrier which can be handled in an alternative manner is known from DE 10 2017 113 053 A1. The heavy goods carrier has, on at least one side wall, a flap which seals a flap opening in the side wall in a closed position and can be brought into an open position by pivoting. The side wall flap is articulated to the side wall using a hinge device formed by a multi-axis joint. It is further provided that when the flap is pivoted a compulsory guide for the flaps converts a rotational movement into a simultaneous translational movement of the flap. The compulsory guide of the flap is arranged on the two lateral edges of the flap opening and on the two edges of the flap. This heavy load carrier could also be improved as regards a pressure from the crate interior. When the heavy load carrier is filled with a lot of material, it is possible for the side wall flap to break out from its mounting. In particular, when locked the flap is merely mounted by way of hook-like projections, which lean against the ramps of the compulsory lock from the inside and engage them from behind.

EP 3 141 492 A1 discloses a heavy load carrier in accordance with the preamble of claim 1. The flap in the side wall is raised to open it, journals laterally attached to the flap being raised out of pockets in the side wall which protrude into the flap opening. Starting from this position, the flap can be rotated about a horizontal axis and flapped flat against the side wall. As a result of the cooperation of the journals with the pockets, the flap cannot be opened by pushing from the crate interior perpendicular to the flap plane when locked. A drawback of the use of journals and pockets is that they can tilt into one another in the event of a pressure from the crate interior perpendicular to the flap plane, making the side wall flap difficult to open.

BRIEF DESCRIPTION OF THE DRAWINGS

Embodiments of the invention are described in the following by way of schematic drawings.

IN THE DRAWINGS

Figure 1:
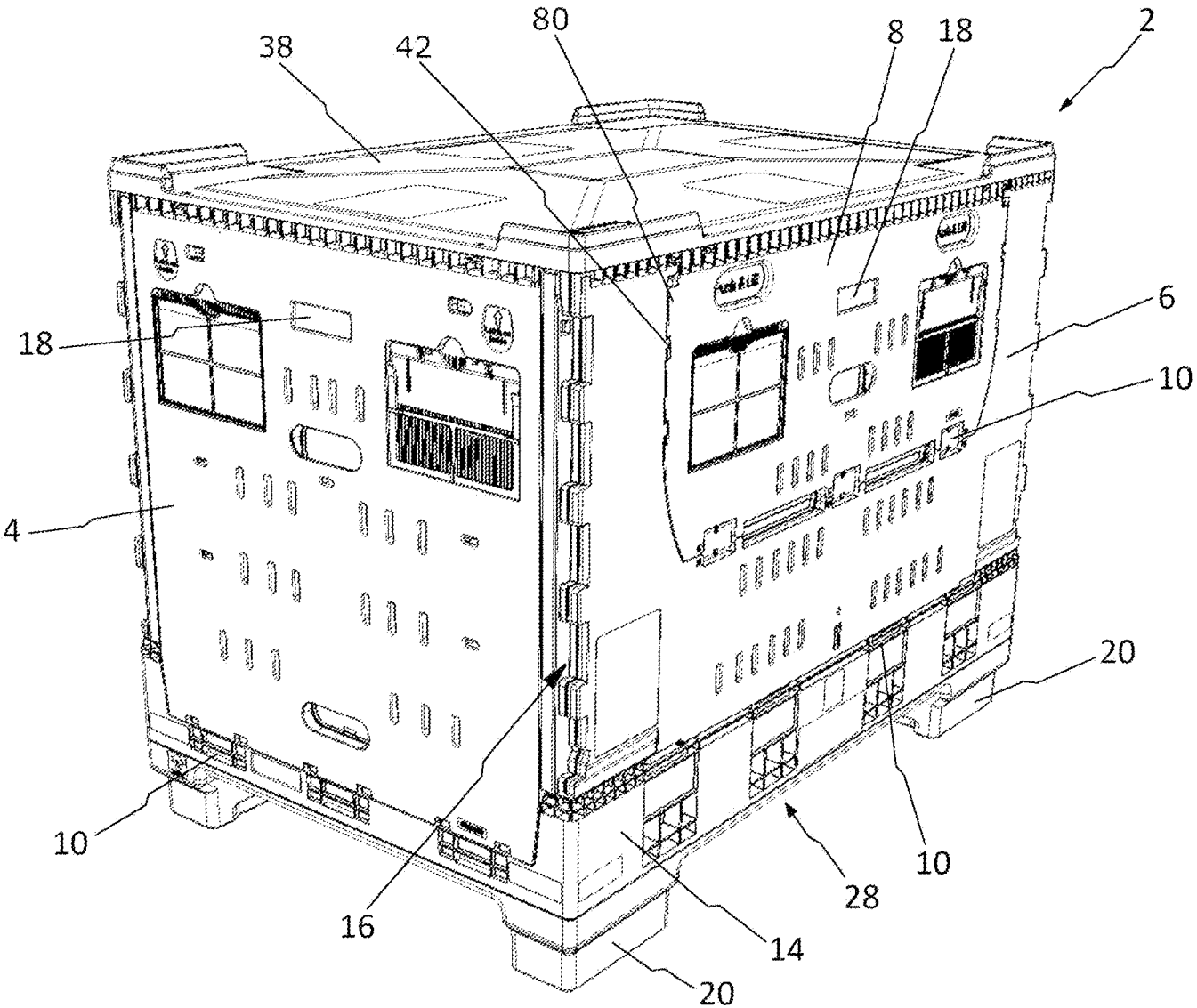
Figure 2:
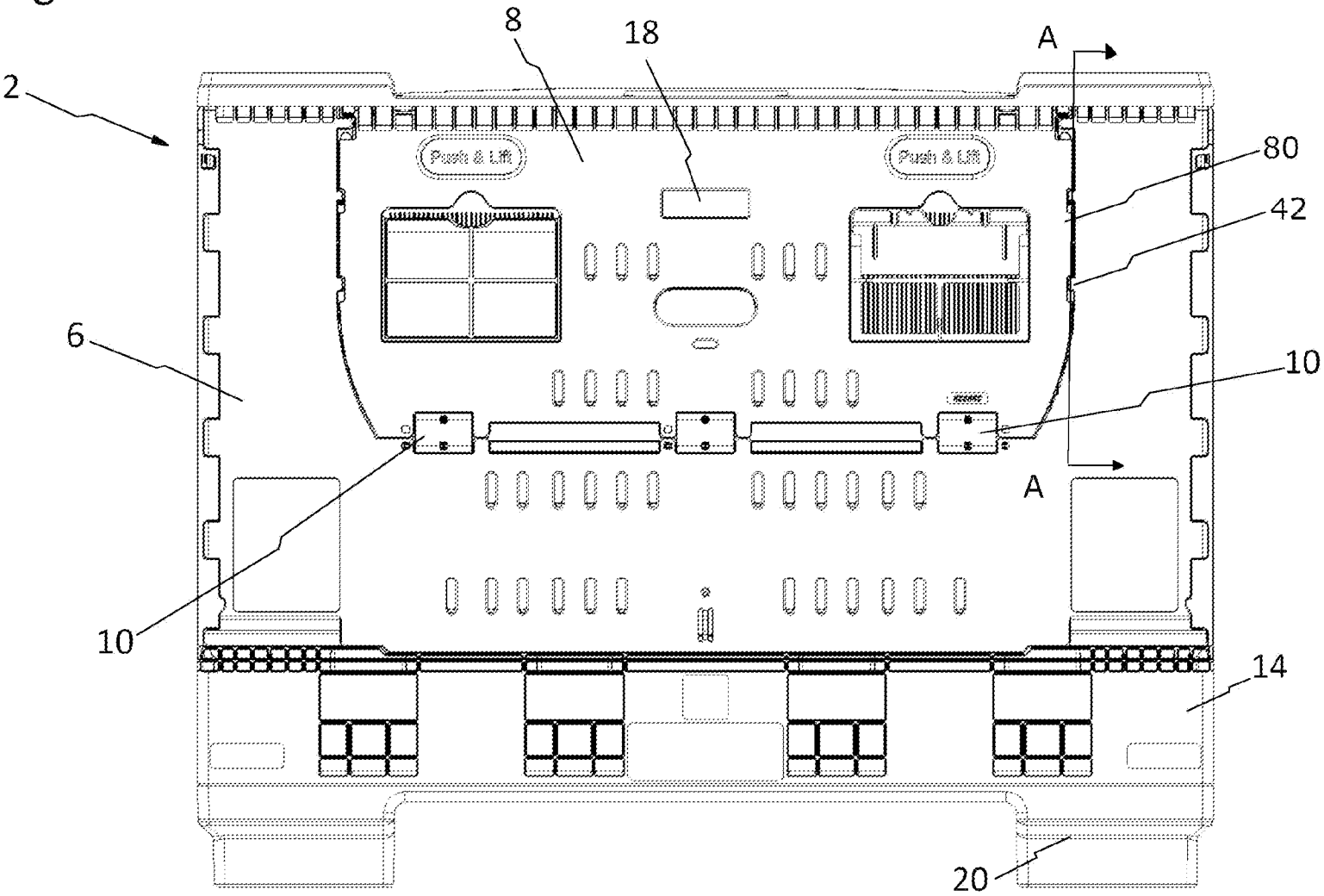
Figure 3:
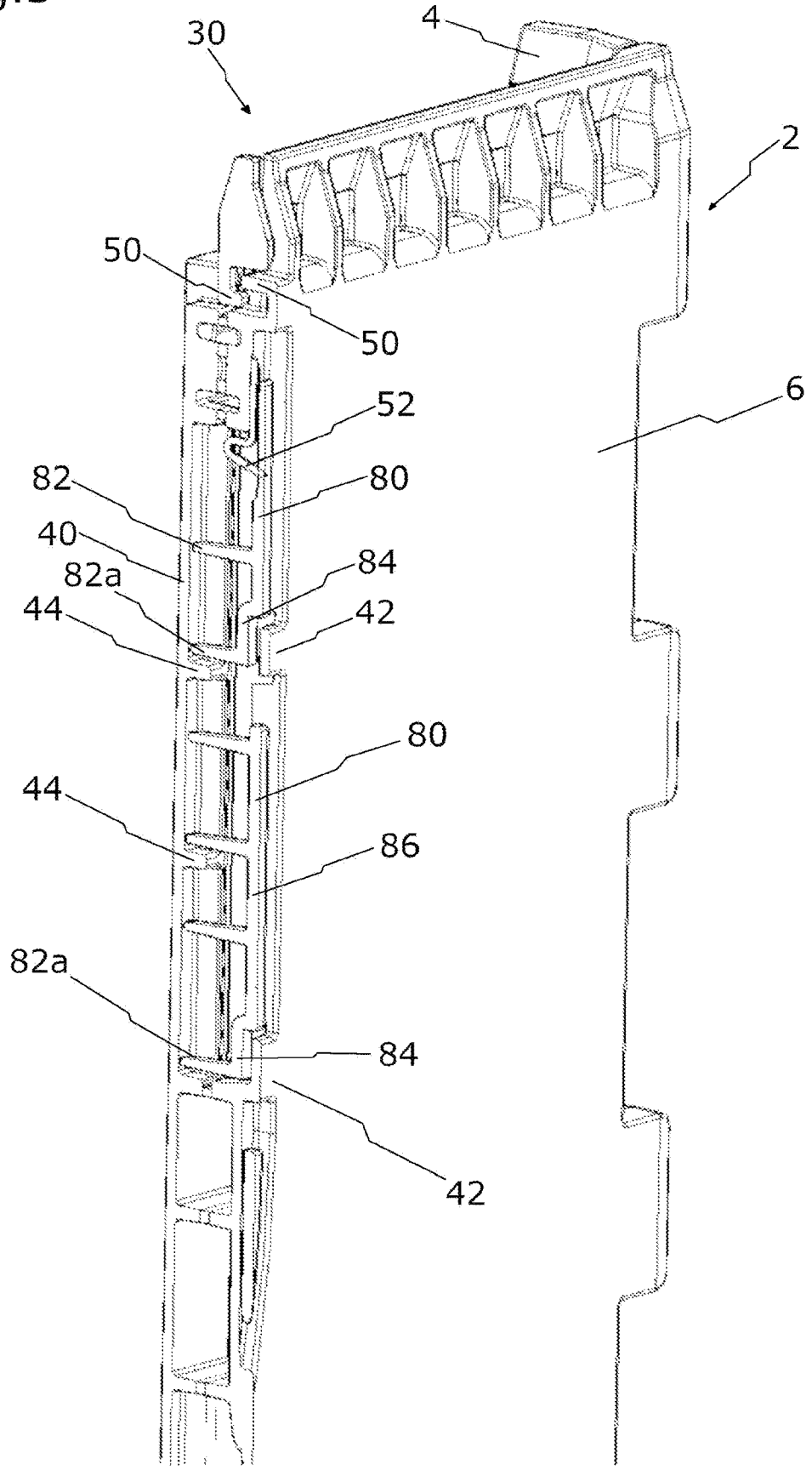
Figure 4:
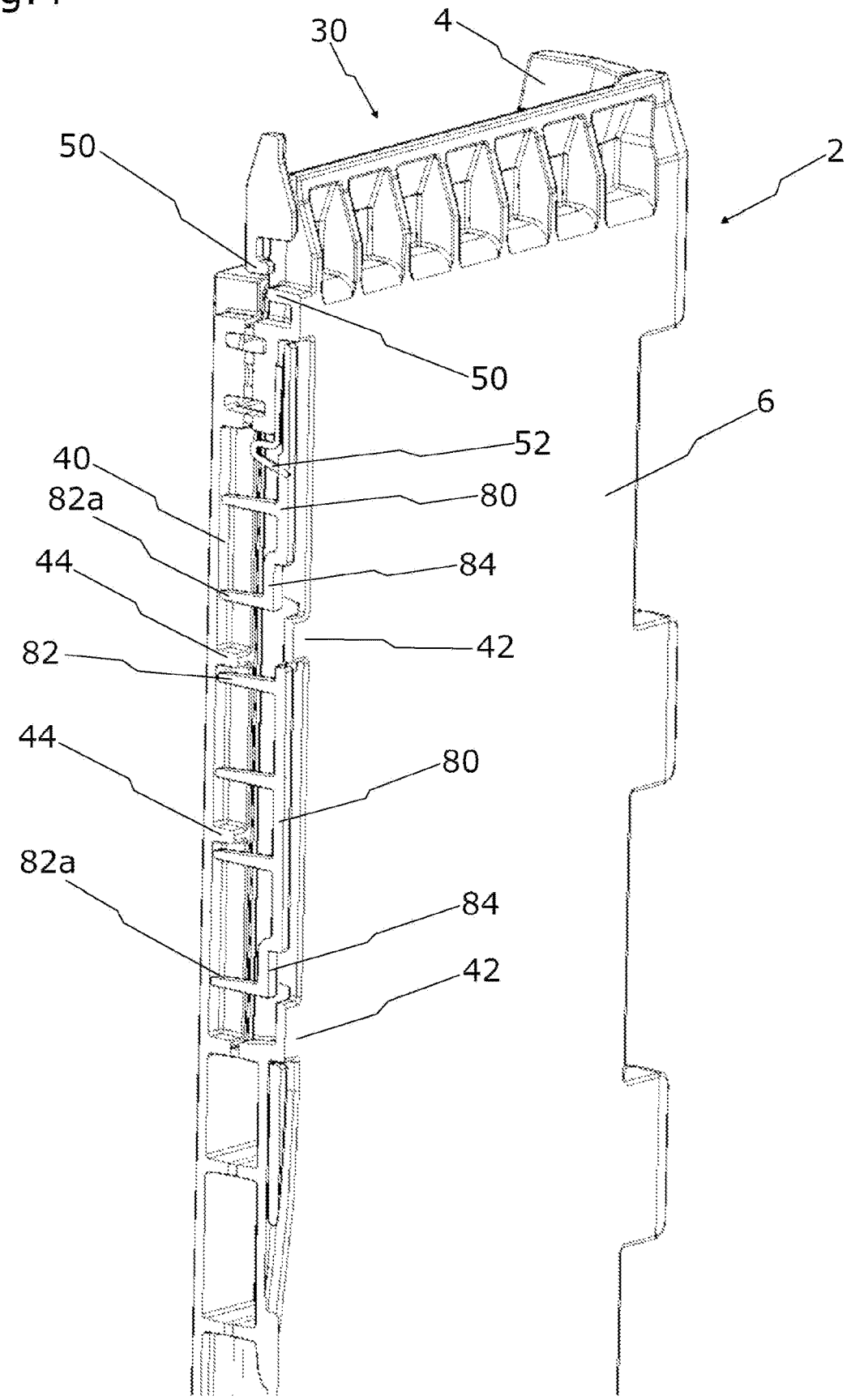

FIG. 1 is a perspective view of a heavy load carrier according to an embodiment of the invention, FIG. 2 is a side view of the heavy load carrier shown in FIG. 1, FIG. 3 is a schematic view of a corner region of the heavy load carrier of FIG. 2 along a section A-A, showing a region of the side wall and a region of the flap with the flap in a locked state;

FIG. 4 is the view of FIG. 3 with the flap in an unlocked state; and

Figure 5:
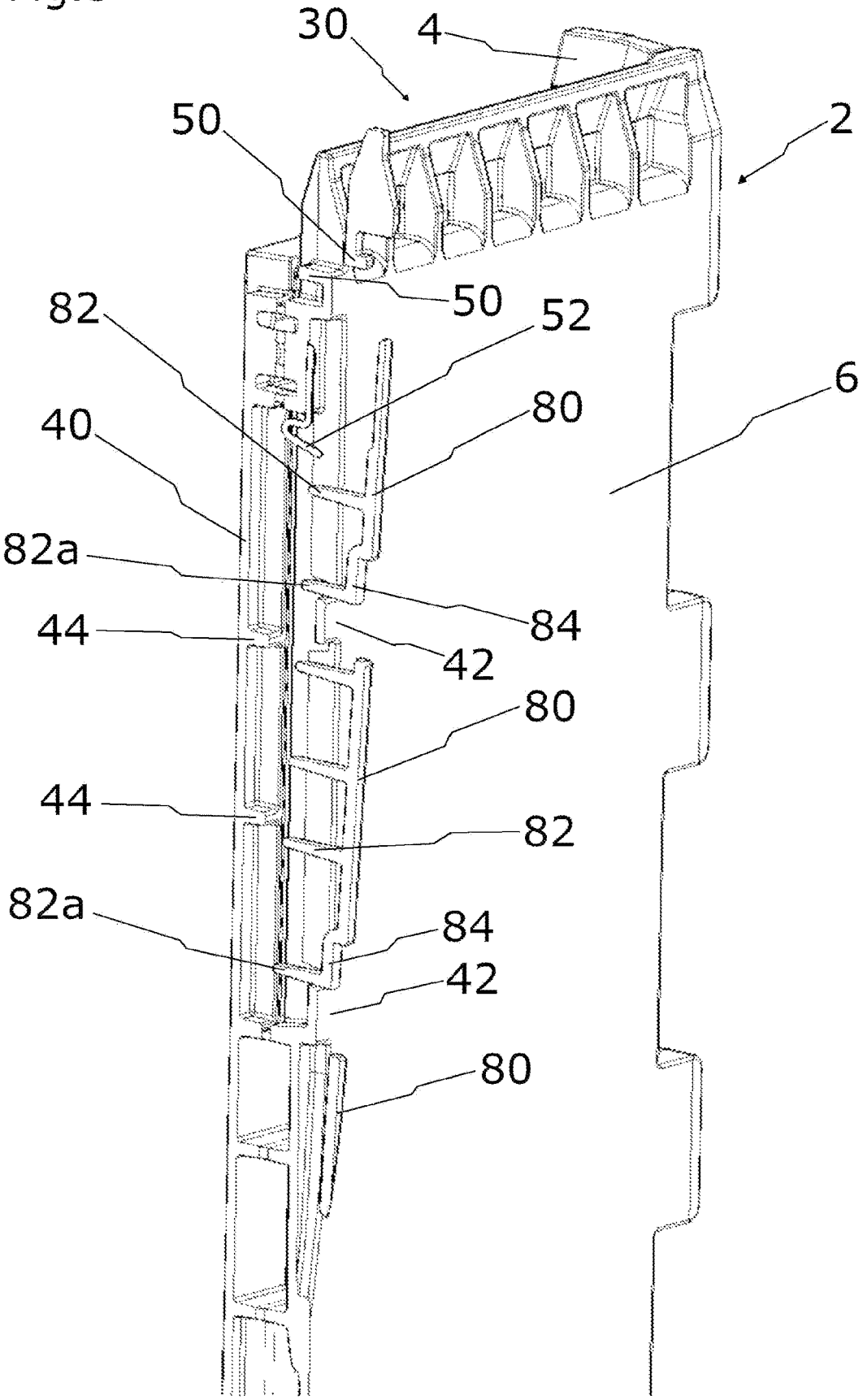

FIG. 5 is the perspective of FIG. 3 with an open position of the flap.

DETAILED DESCRIPTION

Object of the Invention

The object of the invention is to provide a heavy load carrier comprising peripheral side walls and a side wall flap, which withstands a load due to pressures from the crate interior perpendicular to a flap plane and in which the side wall flap can be opened easily even under the load.

Disclosure of the Invention

The object is achieved by a heavy load carrier having the features of claim 1. Advantageous developments of the invention are characterised by the features of the dependent claims.

According to the invention, first locking elements on a side wall flap of the heavy load carrier, referred to as the flap hereinafter, comprise at least one bolt, and second locking elements on a side wall of the heavy load carrier comprise at least one web, particularly preferably a plurality of webs, for example two or three, which are preferably arranged on a face of the side wall remote from the interior of the heavy load carrier. In this context, it is provided that a contact region of the bolt comes into contact with the web in the event of pressure on the flap from the interior of the heavy load carrier perpendicular to the flap plane.

In the locked state, the contact region of the bolt and the web in the side wall delimit the outward movement of the flap. In the unlocked state, the contact region of the bolt is released by the side wall. The bolt and the web give the flap stability in the locked state, and tilting in the event of pressure on the flap from the inside is also effectively prevented, in such a way that the flap can be opened even in a state where contents are loaded in, for example.

The bolt preferably comprises an elongate base portion, preferably in the form of a projection from the flap side wall. The base portion preferably extends in the vertical direction, as can be seen in the closed position. The contact region is preferably connected to the base portion integrally via a shoulder piece.

The web is preferably in the form of a solid, block-like projection projecting into the flap opening.

In this context, a projection is understood to be a component which projects beyond or protrudes into a reference face by a few millimetres to a few centimetres, for example 1 mm to 20 cm, preferably 3 mm to 5 cm, more preferably 5 mm to 3 cm.

The heavy load carrier according to the invention is typically made of individual injection-moulded parts, generally consisting of PP and/or HDPE, and comprises four side walls, a base part and a number of feet fixed thereto or formed integrally with the base part, for example four, eight or nine feet.

The four side walls are preferably articulated foldably to the base part, but rigid embodiments of heavy load carriers comprising non-foldable side walls or even for example integrally formed peripheral side walls also fall within the scope of the present invention. In all embodiments, the side walls in an upright position define the interior of the heavy load carrier together with the base part.

The side walls are formed to be foldable for example by means of hinges, although this should not be understood to be limiting for the invention. In an upright position, the side walls define an interior of the heavy load carrier together with the base part.

At least one of the side walls has the described flap, which seals a flap opening in the side wall in a closed position. In the closed position, a flap plane of the flap, in other words a main face of the flap, extends parallel to the plane of the side wall in which the flap is provided. For example, one or both longer side walls may be equipped with flaps which can be folded outwards beyond the lower side wall part. Alternatively, all four side walls may have flaps. In the folded-up position, the heavy load carrier allows access to the contents from the outside even in a stack, i.e., when it is arranged below another heavy load carrier in a stack. In some embodiments the heavy load carrier allows access to the contents from the outside even when a closed cover is arranged on the side walls.

The flap comprises first locking elements, which can be brought into at least two states together with or separately from the flap, at least in the closed position. A first state of the at least two states is a locked state and a second state is an unlocked state of the flap. If the flap is formed integrally with the first locking elements or if the first locking elements are installed rigidly with respect to the flap, the flap can be brought from the locked state into the unlocked state and back together with the first locking elements. If the first locking elements are mounted loosely or movably with respect to the flap, they can be brought into the locked state and the unlocked state separately from the flap.

In the locked state, the first locking elements cooperate with second locking elements of the side wall and hold them in the locked position. In this position, the flap cannot be opened by pressure on the flap from the interior of the heavy load carrier perpendicular to a flap plane.

In the unlocked state, the flap can be opened by pressure on the flap from the interior of the heavy load carrier perpendicular to the flap plane. In the context of the present disclosure, the flap is in the closed position, in which it seals the flap opening in the side wall, both in the locked state and in the unlocked state. From the closed position, the flap can be brought into an open position for example by pivoting or linear displacement, as is known for example from DE 10 2017 113 053 A1 and DE 10 2008 047 857 A1, the disclosure of these documents being incorporated by reference in its entirety. In the open position, the flap is preferably folded against the side wall from the outside.

The second locking elements are preferably formed integrally with or installed rigidly with respect to the side wall. In a preferred embodiment, they are in the form of projections projecting into the flap opening.

In an advantageous embodiment, the first locking elements, in particular the bolt, have preferably a plurality of first ribs arranged perpendicular to a flap plane, the first ribs counteracting a pressure acting on the flap perpendicular to the flap plane in the locked state. The first ribs extending perpendicular to the flap plane give the flap more stability in the locked state, tilting of the locking mechanism simultaneously being prevented in the event of pressure on the flap from the inside.

In one embodiment, the second locking elements comprise at least one bar, at least one of the first ribs, preferably a plurality of ribs, coming into contact with the bar when the flap is pressed perpendicular to the flap plane from the outside. The bar is preferably arranged on a face of the side wall facing the interior of the heavy load carrier, although this is not limiting for the invention. By stopping against the bar, the ribs delimit the movement of the flap towards the interior of the heavy load carrier and thus form part of its locking system.

In a preferred embodiment, at least one first rib extends out perpendicularly from the contact region of the bolt towards the interior. In the event of a pressure on the flap from the interior of the heavy load carrier perpendicular to the flap plane, the rib brings about a force distribution of the pressure over its longitudinal axis, and prevents the contact region from buckling away under the pressure. This embodiment is thus particularly stable against pressure from the interior.

On the side wall, there is at least one stop element in the form of a second rib extending perpendicular to a side wall plane. The stop element delimits the movement of a first rib when the flap is brought from the locked state into the unlocked state or vice versa. If the stop element forms the stop of the first rib in the locked state, the flap is advantageously held vertically in position by the cooperation of the stop element with the rib. As a result, the hinge region of the side flap can advantageously be unloaded/relieved.

The second rib is preferably and by way of example in the form of a projection projecting into the flap opening. The second rib may be formed integrally with or fixed to the side wall.

In preferred embodiments, the first rib extends over a main face of the flap in the flap plane. This gives the flap more stability overall. The extension may in particular be horizontal over the main face, and in particular from one side face to the other side face of the flap, where they form locking elements.

It is preferably provided that the flap has the first locking elements, which cooperate with corresponding second locking elements of the side wall, on both side faces.

In a preferred embodiment, the first locking elements comprise at least one hook and/or one undercut. The second locking elements likewise preferably comprise at least one hook and/or one undercut. In this context, the hooks or a hook and an undercut cooperate in such a way that the flap is held in the locked state. The hooks or undercuts are preferably formed on the upper edge region of the flap, in particular on the upper edge thereof, in such a way that opening and closing the side flap is made easier for the user by way of the hooks.

The hooks and/or undercuts of the second locking elements may in particular be in the form of projections projecting into the flap opening. The hooks and/or undercuts of the first locking elements may be in the form of projections protruding from a side face of the flap opening.

As is known for example from DE 10 2017 113 053 A1, the first and second locking elements may be braced against unlocking by means of a resilient element, in particular by means of a spring, in the locked state.

If the first locking elements are installed rigidly with respect to the flap, the first locking elements are brought from the locked state into the unlocked state for example by a linear displacement of the flap. If the first locking elements are installed loosely with respect to the flap, the first locking elements are brought from the locked state into the unlocked state in the plane of the side wall.

In the context of the present disclosure, the foot region of the heavy load carrier can be configured freely to some extent. For example, the heavy load carrier may have four corner feet or alternatively four corner feet and four further support feet arranged in the centres of the side walls and additionally or alternatively also a support foot in the centre of the base part. The feet may be rigidly screwed to, clipped to or formed integrally with the base part.

The base part comprises for example planar side wall portions and typically an integrally formed base plate.

The dimensions of the foot regions of the heavy load carrier correspond for example to the standardised requirements on a Euro pallet according to EN 13698-1:2003, in such a way that the heavy load carriers can be handled using the same devices, in particular floor conveyors, as the Euro pallet. The standard is cited in its January 2004 edition. In various embodiments, the foot regions may be connected to runners, in particular to improve stability. Between the base part and the runners, recesses for the prongs of floor conveyors are typically present. The runners may be rigidly screwed to, clipped to or formed integrally with one another.

At the lower face, this results in a pallet-like construction of the heavy load carrier, which may in particular comprise nine feet as well as runners each connecting three feet along the longitudinal face of the heavy load carrier, in a manner corresponding to the Euro pallet standardised under EN 13698-1.

It may further be provided that the side walls and the flaps have upper edge regions comprising support faces for receiving feet of a similarly formed heavy load carrier in a stack, the support faces being arranged countersunk with respect to edge portions of the side walls, for example. The upper edge regions of the side walls and flaps comprise for example edge portions which protrude approximately vertically upwards with respect to the support faces. The feet of a similarly formed heavy load carrier in the stack may thus be enclosed peripherally at least in part.

The support faces of the side walls and flaps are preferably such that they can receive pallets having footprints of a standard size, in particular Euro pallets standardised under European Standard EN 13698-1 and having 1200 mm×800 mm footprints. Accordingly, the support faces in the region of the upper edge regions of the side walls and flaps are of at least the standard size, in particular 1200 mm×800 mm. The feet of the heavy load carrier also form for example a footprint of the standard size, in particular 1200 mm×800 mm.

The heavy load carrier may be provided with a cover, which is positioned on the edge portion and simultaneously on the support face of the upper edge region so as to achieve good load transfer of a container stacked above.

The heavy load carrier according to the invention is suitable in particular for receiving piece goods such as high-volume foodstuffs, as well as in non-food industry, for example in the automotive industry. The heavy load carrier is configured thicker than conventional fruit and vegetable containers, and is also heavier overall, and so the filled heavy load carriers are generally transported mechanically, in particular by forklift trucks and the like.

Embodiments of the Invention

In the following, like elements are provided with like reference numerals. Like elements are not described repeatedly for each individual drawing.

FIG. 1 is a perspective view of a heavy load carrier 2 according to an embodiment of the invention.

The heavy load carrier 2 comprises a first side wall 4 and a second side wall 6, the first side wall 4 forming a narrower face of the heavy load carrier, and the second side wall 6 forming a longer face of the heavy load carrier 2.

In the second side wall 6 there is a flap 8, which here is linked to the second side wall 6 by hinge devices 10, purely by way of example. In embodiments which are not shown, the flap 8 may also be provided on the first, smaller side wall 4 or on both side walls 4, 6. The flap 8 is to be opened manually by way of a latching and adjustment mechanism and a gripping opening 18, in such a way that the interior of the heavy load carrier 2 can be accessed from the outside. In general, the cover 38, shown in FIG. 1, is taken off in this context, but in some embodiments it may also be provided that the flap 8 can be opened even when the cover 38 is on. In embodiments which are not shown, removable flaps 8 may be provided.

The side walls 4, 6 are formed substantially with a closed face towards the outside, although this is not limiting for the invention. The side walls 4, 6 may also in particular have an open rib structure towards the outside, as is known in the art.

In the lower region, the heavy load carrier 2 has feet 20, specifically, purely by way of example, four feet 20 arranged at the corners in the embodiment shown, although this is not limiting for the invention.

The feet 20 are fixed to a peripheral base part 14, for example by screwing or clipping. The side walls 4, 6 are arranged foldably on the base part 14 by means of further hinge devices 10, it being made possible for all four sides to be folded in completely by way of different heights of the base part 14 in the region of the hinges, as is known in the art.

FIG. 1 shows a closed state of the heavy load carrier 2, in which, in particular, the side walls 4, 6 have been set up and hooked into one another by means of a latching mechanism 16 (not described in greater detail). The flap 8 is closed, in other words in a closed position, and in addition the cover 38 is placed on the upper face.

FIG. 2 is a side view of the heavy load carrier 2 of FIG. 1.

FIG. 3-5 show the heavy load carrier 2 along the section line A-A of FIG. 2. Of the flap 8, merely a region of projections projecting into the side wall 6 is shown, said region comprising first locking elements which cooperate with second locking elements of the side wall 6 so as to form, in a closed position shown in FIGS. 3 and 4 of the flap 8, a locked state (FIG. 3) and an unlocked state (FIG. 4), as is described in greater detail in the following.

FIG. 3 shows the heavy load carrier 2 with the flap 8 in the closed position in a locked state.

In the locked state, a contact region 84 of a bolt 80 of the flap 8 comes into contact with a web 42, which projects on the side wall 6 as a projection into the flap opening. As a result of the contact of the contact region 84 with the web 42, movement of the flap 8 in the event of pressure on the flap 8 from the interior 30 of the heavy load carrier 2 perpendicular to the flap plane is blocked. The first locking elements on the flap 8 comprise first ribs 82, which are arranged perpendicular to the flap plane and extend perpendicularly from a base portion 86 of the bolt 80. The base portion 86 of the bolt 80 extends substantially in the flap plane. The first ribs 82 also correspondingly extend perpendicular to the flap plane. In the locked state shown in FIG. 4, the first ribs 82 counteract pressures acting on the flap 8 perpendicular to the flap plane. In particular, first ribs 82*a* extending out perpendicularly from the contact region 84 of the bolt 80 counteract a pressure on the flap 8 from the interior of the heavy load carrier 2 perpendicular to the flap plane.

The first ribs 82 also come into contact with a bar 40 arranged on the face of the side wall 6 facing the interior 30 of the heavy load carrier 2 when the flap 8 is pressed from the outside perpendicular to the flap plane.

Correspondingly, in the locked state the first ribs 82 counteract a pressure acting on the flap 8 perpendicular to the flap plane.

On the side wall 6, two ribs 44 in the form of projections projecting into the flap opening are arranged, specifically extending perpendicular to a side wall plane. The second ribs 44 form stop elements which delimit a downward movement of a first rib 44 in the locked state (see FIG. 3). In the locked state, the flap 8 may be positioned on the second ribs 44 of the side wall 6, although this is not limiting for the invention. In the unlocked state 5, the second ribs 44 may likewise delimit the movement of the first ribs 82, specifically from above (see FIG. 4). The delimitation of the movement of the flap by the second ribs 44 may for example serve to unburden the hinges 10.

The bars 40, webs 42 and second ribs 44 located in the side wall 6 are advantageously formed as projections projecting into the flap opening, in such a way that wedging or jamming of the side wall 6 cannot occur in the event of a pressure in particular outwards from the interior 30 of the heavy load carrier 2 in conjunction with the projections of the flap 8.

FIG. 4 shows the heavy load carrier 2 with the flap 8 in a closed position in an unlocked state, which is characterised in that the flap 8 can be opened by pressing the flap 8 from the interior 30 of the heavy load carrier 2 perpendicular to the flap plane. In the closed position, however, the flap opening seals the side wall 6.

In the unlocked state shown in FIG. 4, the contact regions 84 are not in contact with the webs 42, in other words they do not touch one another.

Moreover, in the unlocked state, the first and second locking elements in the form of hooks 50 are released from one another. The hooks 50 are located in the upper region of the side wall 6 and flap 8, and are formed so as to engage in one another in the locked state, as is known in the art, in particular from DE 10 2017 113 053 A1.

FIG. 5 shows the flap 8 in an open position, in which the flap 8 therefore no longer seals the flap opening in the side wall 6. The flap 8 has been brought from the unlocked state in FIG. 4 into the open position in FIG. 5 by pivoting. Reference numeral 52 denotes a spring which prevents unintended opening of the flap 8. The hooks 50 are orientated so as to be braced against unlocking by means of the spring in the locked state. In other words, a force must first be applied counter to the spring tension to release the hooks 50 from one another.

It will be appreciated that the locking elements shown of the flap 8 may also be fixed loosely to the flap 8, for example using floating bearings. Depending on the embodiment, the locking elements are brought from the locked state into the unlocked state by linearly displacing the flap 8 or by displacing the loosely mounted first locking elements in the plane of the side wall 6.

The invention is not limited to the embodiments described here. Rather, a plurality of modifications are possible within the scope of technical knowledge.

LIST OF REFERENCE NUMERALS

2 Heavy load carrier; 4 First side wall; 6 Second side wall; 8 Flap, 10 Hinge device; 14 Base part; 16 Latching mechanism; 18 Gripping opening; 20 Foot; 28 Clearance for prongs of a floor conveyor; 30 Interior; 38 Cover; 40 Bar; 42 Web; 44 Second rib; 50 Hooks; 52 Spring; 80 Bolt; 82, 82*a* First rib; 84 Contact region; 86 Base portion.

The invention claimed is:

1. A heavy load carrier comprising peripherally arranged side walls which in an upright position define an interior of the heavy load carrier together with a base part, at least one of the side walls having a flap which seals a flap opening in the at least one side wall in a closed position, the flap comprising first locking elements which can be brought into at least two states, together with or separately from the flap, at least in the closed position, wherein in a locked state the first locking elements cooperate with second locking elements of the at least one side wall, in such a way that the flap cannot be opened by pressure on the flap from the interior of the heavy load carrier perpendicular to a flap plane, and wherein in an unlocked state the flap can be opened by pressure on the flap from the interior of the heavy load carrier perpendicular to the flap plane, characterised in that the first locking elements comprise at least one bolt and the second locking elements comprise at least one web, wherein in the locked state a contact region of the bolt comes into contact with the web in the event of a pressure on the flap from the interior of the heavy load carrier perpendicular to the flap plane.

2. The heavy load carrier according to claim 1, characterised in that the web is arranged on a face of the side wall remote from the interior of the heavy load carrier.

3. The heavy load carrier according to claim 1, characterised in that the web is in the form of a block-like projection projecting into the flap opening.

4. The heavy load carrier according to claim 1, characterised in that the first locking elements, in particular the bolt, have at least one first rib arranged perpendicular to a flap plane, the first rib counteracting a pressure acting on the flap perpendicular to the flap plane in the locked state.

5. The heavy load carrier according to claim 4, characterised in that the second locking elements comprise at least one bar, which is arranged on a face of the side wall facing the interior of the heavy load carrier, the first rib coming into contact with the bar when the flap is pressed from the outside perpendicular to the flap plane.

6. The heavy load carrier according to claim 4, characterised in that at least one first rib extends out perpendicularly from the contact region of the bolt.

7. The heavy load carrier according to claim 4, characterised in that the first rib extends over a main face of the flap in the flap plane.

8. The heavy load carrier according to claim 1, characterised in that at least one stop element, in the form of a second rib extending perpendicular to a side wall plane, is arranged on the side wall, and delimits a movement of at least one first rib during the transfer from the locked state into the unlocked state or from the unlocked state into the locked state.

9. The heavy load carrier according to claim 8, characterised in that the second rib is in the form of a projection projecting into the flap opening.

10. The heavy load carrier according to claim 1, characterised in that on each of the two faces the flap has a bolt which cooperates with second locking elements located in the side wall.

11. The heavy load carrier according to claim 1, characterised in that the first and second locking elements each comprise at least one hook and/or one undercut, the hooks and/or undercuts holding the flap in the locked state.

12. The heavy load carrier according to claim 11, characterised in that the hook and/or the undercut of the second locking elements are in the form of projections projecting into the flap opening.

13. The heavy load carrier according to claim 1, characterised in that the first and second locking elements are braced against unlocking by means of a resilient element, in particular by means of a spring, in the locked state.

14. The heavy load carrier according to claim 1, characterised in that the first locking element is brought from the locked state into the unlocked state by linearly displacing the flap and/or first locking elements in the plane of the side wall.

15. The heavy load carrier according to claim 1, characterised in that the flap can be brought from the closed position into an open position by pivoting.

* * * * *